US009573387B2

(12) United States Patent
Shinoda et al.

(10) Patent No.: US 9,573,387 B2
(45) Date of Patent: Feb. 21, 2017

(54) PRINTING APPARATUS AND PRINTING METHOD

(71) Applicant: SEIKO EPSON CORPORATION, Tokyo (JP)

(72) Inventors: Tomoki Shinoda, Shiojiri (JP); Kazuyuki Fujioka, Matsumoto (JP); Keiji Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/532,615

(22) Filed: Nov. 4, 2014

(65) Prior Publication Data

US 2015/0124034 A1 May 7, 2015

(30) Foreign Application Priority Data

Nov. 6, 2013 (JP) ..... 2013-230033

(51) Int. Cl.
*B41J 11/00* (2006.01)
*B41F 17/38* (2006.01)
*B41J 3/407* (2006.01)

(52) U.S. Cl.
CPC ..... *B41J 11/0015* (2013.01); *B41F 17/38* (2013.01); *B41J 3/4078* (2013.01)

(58) Field of Classification Search
CPC ..... B41F 23/002; B41F 23/00; B41F 21/00; B41F 17/38; B41J 29/17; B41J 3/4078; B41J 11/0015
USPC ..... 347/104, 101, 16, 34
See application file for complete search history.

(56) References Cited

U.S. PATENT DOCUMENTS 4,703,537 A * 11/1987 Yamamoto ..... G21K 4/00 15/102
5,300,952 A * 4/1994 Wada ..... G03G 5/02 346/135.1
5,979,011 A * 11/1999 Miyawaki ..... B08B 1/007 15/104.002
6,030,076 A 2/2000 Yoshimura et al.
6,725,776 B2 * 4/2004 Takata ..... G03B 42/04 101/423
8,186,826 B2 * 5/2012 Sakano ..... B41J 29/17 347/104
8,342,673 B2 * 1/2013 Yoda ..... B41J 11/002 347/102
2004/0141041 A1 * 7/2004 Tsutsumi ..... B41J 2/2056 347/102
2007/0188578 A1 * 8/2007 Kayanaka ..... B41J 3/28 347/104
2012/0062677 A1 * 3/2012 Sawada ..... B41J 2/175 347/104

(Continued)

FOREIGN PATENT DOCUMENTS

JP 06-015818 1/1994
JP 10-168765 6/1998

(Continued)

*Primary Examiner* — Henok Legesse
(74) *Attorney, Agent, or Firm* — Workman Nydegger

(57) ABSTRACT

A printing apparatus includes a removal portion that removes attached materials attached to a printing surface by coming in contact with the printing surface of a printing medium; a pressing portion that presses the printing surface with which the removal portion is in contact; and a liquid ejecting portion that performs printing by ejecting a liquid with respect to the printing surface pressed by the pressing portion.

17 Claims, 5 Drawing Sheets

(56) References Cited

U.S. PATENT DOCUMENTS

2013/0201266 A1 8/2013 Usuda et al.

FOREIGN PATENT DOCUMENTS

| | | |
|---|---|---|
| JP | 2013-019083 | 1/2013 |
| JP | 2013-159881 | 8/2013 |

* cited by examiner

PRINTING APPARATUS AND PRINTING METHOD

BACKGROUND

1. Technical Field

The present invention relates to a printing apparatus, such as a printer, and a printing method.

2. Related Art

One example of a printing apparatus is an ink jet textile printing apparatus that performs printing of a T-shirt by ejecting ink on a T-shirt that is a material to be printed from an ink jet head that is a printing execution portion, thereby printing a design (for example, JP-A-2013-19083).

Incidentally, in the textile printing apparatus as described above, when the ink jet head approaches the printing material and ejects ink, fluff or lint attached to the printing material comes into contact with the ink jet head, which may lead to ink ejection defects. At this time, when attached materials, such as fluff, attached to the printing material adheres to the ink jet head, ink mist that occurs along with the ejection of ink may condense on the surface of the attached material and drops onto the printing material, thereby lowering the printing quality. That is, there is a problem in that when fluff or the like attaches to the printing material, a lowering of the quality of printing stemming from the materials thus attached may occur.

Such a problem is not limited to a textile printing apparatus that performs printing on a printing material, and is generally common in printing apparatuses that perform printing by ejecting a liquid with respect to a printing medium.

SUMMARY

An advantage of some aspects of the invention is to provide a printing apparatus and a printing method capable of suppressing a lowering of the print quality stemming from attached materials attached to the printing medium.

Hereinafter, means of the invention and operation effects thereof will be described.

According to an aspect of the invention, there is provided a printing apparatus including a removal portion that removes attached materials attached to a printing surface by contacting the printing surface of a printing medium; a pressing portion that presses the printing surface with which the removal portion is in contact; and a liquid ejecting portion that performs printing by ejecting a liquid with respect to the printing surface pressed by the pressing portion.

According to the configuration, since the attached materials attached to the printing surface are removed by the removal portion that contacts the printing surface, it is possible to suppress a lowering of the print quality stemming from attached materials attached to the printing medium. Although there is concern of the printing surface being fluffed, being wrinkled, or the like, and the condition of the surface thereof being disturbed when the removal portion comes in contact with the printing surface, it is possible to flatten the printing surface by a pressing portion pressing the printing surface which the removal portion contacts. Since the liquid ejecting portion ejects a liquid with respect to a printing surface flattened by the pressing of the pressing member, it is possible to suppress a lowering of the print quality stemming from contact of the removal portion.

It is preferable that the printing apparatus further include a pressing roller that includes a harder outer peripheral surface than the printing medium, able to rotate in a state in which the hard outer peripheral surface is in contact with the printing surface, in which the pressing portion is formed from the outer peripheral surface of the pressing roller.

According to the configuration, since the outer peripheral surface of the pressing roller is harder than the printing medium, it is possible to flatten the printing surface through the pressing portion formed from the hard outer peripheral surface pressing the printing surface. It is possible to reduce the frictional resistance occurring between the pressing portion and the printing surface through the pressing roller rotating when the pressing portion presses the printing surface. Accordingly, it is possible to suppress disturbance of the printing surface stemming from the pressing portion contacting the printing medium.

It is preferable that the printing apparatus further include an adhesive roller that includes an adhesive outer peripheral surface and is able to rotate in a state in which an adhesive outer peripheral surface thereof is in contact with the printing surface, and in which the removal portion is formed from the outer peripheral surface of the adhesive roller.

According to this configuration, since the outer peripheral surface of the adhesive roller is adhesive, it is possible to remove the attached materials attached to the printing surface through the removal portion formed from the outer peripheral surface with adhesiveness contacting the printing surface. It is possible to reduce the frictional resistance occurring between the removal portion and the printing surface through the adhesive roller rotating when the removal portion contacts the printing surface. Accordingly, it is possible to suppress disturbance of the printing surface stemming from the removal portion contacting the printing medium.

In the printing apparatus, the adhesive roller rotates in a state in which the outer peripheral surface comes in contact with the printing surface, when the pressing portion presses the printing surface.

According to the configuration, when the adhesive outer peripheral surface separates from the printing surface according to the rotation of the adhesive roller, it is possible to peel the printing medium from the adhesive roller while suppressing floating up of the printing medium through the pressing portion pressing the printing surface.

It is preferable that the printing apparatus further include a housing portion that holds the removal portion, the pressing portion, and the liquid ejecting portion, and a mounting portion that moves relative to the housing portion in a state in which the printing medium is mounted, in which the removal portion and the pressing portion contact the printing surface of the printing medium mounted on the mounting portion according to the relative movement.

According to the configuration, it is possible for the printing medium mounted on the mounting portion, the removal portion held by the housing portion, and the pressing portion to come into contact with each other by the mounting portion moving relative to the housing portion in a state in which the printing medium is mounted on the mounting portion.

It is preferable that the printing apparatus further include a detector that detects the presence of an obstruction with the potential to interfere with respect to the liquid ejecting portion by projecting from the printing surface, on the printing surface pressed by the pressing portion.

According to the configuration, it is possible to detect the presence of an obstruction with respect to such a liquid ejecting portion before the obstruction, such as attached materials attached to the printing surface or wrinkles in the printing medium obstructs the liquid ejecting portion through the detector performing detection on the printing surface pressed by the pressing portion.

According to another aspect of the invention, there is provided a printing method including removing attached materials attached to the printing surface coming in contact with a printing surface of a printing medium; pressing the printing surface after the removal; and ejecting a liquid with respect to the printing surface, after the pressing in order to perform printing.

According to the configuration, it is possible to obtain the same operation effect as that of the above-described printing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Below, a first embodiment of the printing apparatus will be described with reference to the drawings. The printing apparatus, for example, is an ink jet printer (textile printing apparatus) that performs printing through textile printing by ejecting ink that is an example of a liquid on the printing surface with the cloth surface of a fabric (T-shirt), which is an example of a printing medium, as a printing surface.

Figure 1:
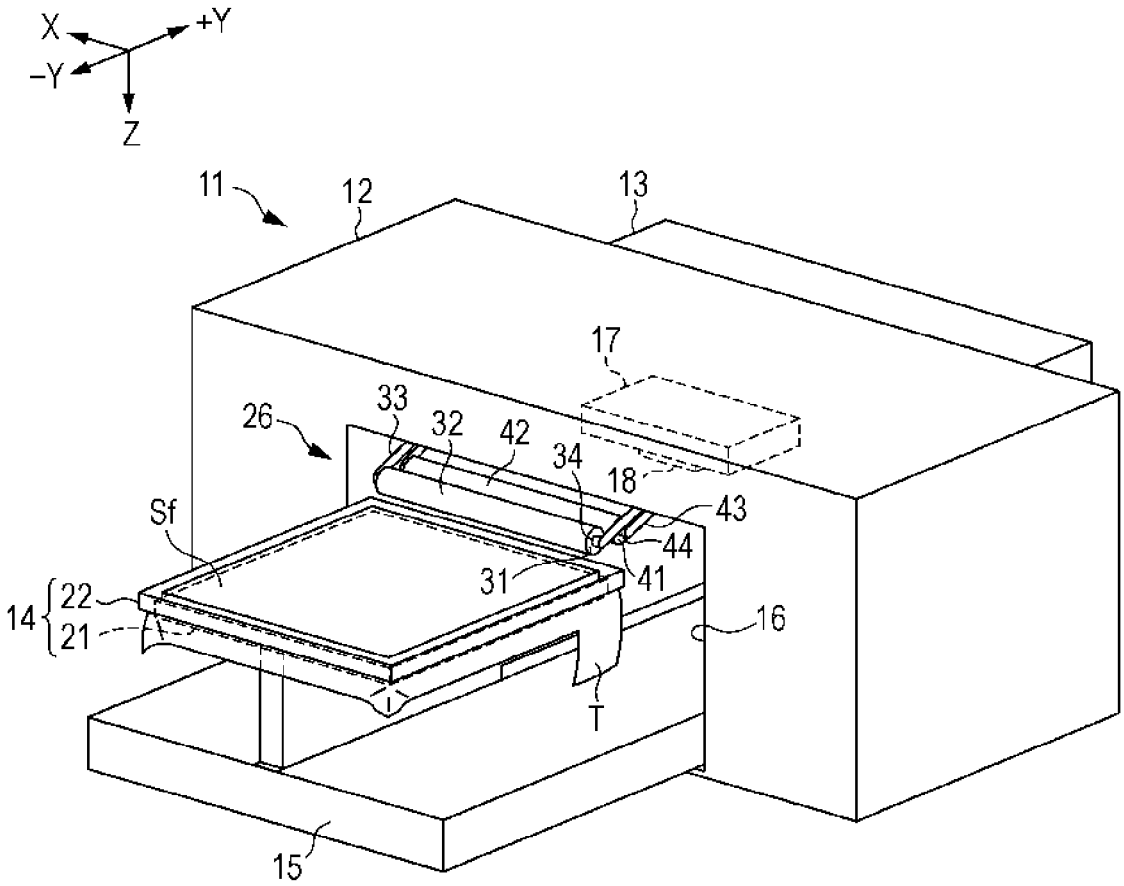
FIG. 1 is a perspective view of a printing apparatus of a first embodiment.

As shown in FIG. 1, the printing apparatus 11 of the embodiment includes a substantially rectangular box-like housing portion 12, an accommodation portion 13 protruding from the housing portion 12, a mounting portion 14 able to reciprocate in a state in which the printing medium T is mounted, and a transport portion 15 for the mounting portion 14 to be reciprocated.

In the present embodiment, the direction in which the accommodation portion 13 protrudes from the housing portion 12 is referred to as backward, and the direction in which the transport portion 15 protrudes from the housing portion 12 is referred to as forward. Along with making the direction in which the transport portion 15 causes the mounting portion 14 to be moved forward toward the accommodation portion 13 side from the housing portion 12 side in the movement direction +Y, the direction in which the transport portion 15 causes the mounting portion 14 to be moved to return toward the housing portion 12 side from the accommodation portion 13 side (reverse direction to the movement direction +Y) is made the movement direction −Y.

On the front surface side of the housing portion 12, an opening portion 16 is formed that permits mounting portion 14 to enter and exit the housing portion 12 when the mounting portion 14 moves along the movement direction Y (+Y, −Y). A space that permits movement of the mounting portion 14 is formed along the housing portion 12 and the accommodation portion 13 on the interior of the housing portion 12 and the accommodation portion 13. The accommodation portion 13 accommodates the mounting portion 14 in which the rear end is moved further backward than the housing portion 12.

The processing mechanism 26 that performs surface treatment for preparing the surface state of the printing surface Sf of the printing medium T prior to subjecting the printing medium T to printing is held in the vicinity of the opening portion 16 of the housing portion 12. The processing mechanism 26 includes rotating support portions 33 and 43, shaft portions 34 and 44 attached to the tips of the rotating support portions 33 and 43, an adhesive roller 31, and a pressing roller 41. The adhesive roller 31 includes an adhesive outer peripheral surface 32 and is attached to the shaft portion 34. The pressing roller 41 includes a harder outer peripheral surface 42 than the printing medium T, and is attached to the shaft portion 44.

The outer peripheral surface 32 of the adhesive roller 31 comes in contact with the printing surface Sf of the printing medium T prior to printing and functions as a removal portion that removes attached materials, such as fluff or lint, attached to the printing surface Sf. The outer peripheral surface 42 of the pressing roller 41 functions as a pressing portion that presses the printing surface Sf prior to printing. The adhesive roller 31 is arranged further to the upstream side in the movement direction +Y than the pressing roller 41. That is, the processing mechanism 26 performs surface processing that removes attached materials by the adhesive roller 31 coming in contact with the printing surface Sf of the printing medium T, and thereafter performs surface processing in which the pressing roller 41 presses the printing surface Sf prior to printing in contact with the outer peripheral surface 32 of the adhesive roller 31.

It is possible for the adhesive roller 31 to be, for example, an adhesive tape having an adhesive surface wound around a core such that the adhesive surface becomes the outer peripheral surface 32, thus having a roll shape. In a case in which the adhesive surface of the wound, roll-like adhesive tape is the outer peripheral surface 32, if the adhesive tape is peeled off, a new adhesive surface is exposed, thereby restoring the adhesiveness of the adhesive roller 31.

The adhesive roller 31 may also be a cylindrical roller with an adhesive layer formed on the outer peripheral surface 32 thereof. In a case in which the adhesive layer formed on the outer peripheral surface 32 is the removal portion, it is preferable that the adhesive roller 31 have an attachable/detachable configuration with respect to the shaft portion 34, the adhesive roller 31 be able to be removed from the shaft portion 34, and remove attached materials attached to the surface of the outer peripheral surface 32.

The pressing roller 41 is, for example, formed by a metal material, and able to press the printing surface Sf under its own weight. In a case in which a strengthened pushing force due to the pressing roller 41 is desired, the pressing roller 41 may be biased in a direction approaching the printing surface Sf by a biasing member, such as a spring. If the pressing roller 41, shaft portion 44 and rotating support portion 43 are made from metal, and the pressing roller 41 is grounded via the shaft portion 44 and the rotating support portion 43, it is possible to remove static electricity generated by the adhesive roller 31 or the pressing roller 41 contacting the printing medium T.

The adhesive roller 31 and the pressing roller 41 may be arranged in the housing portion 12. However, it is preferable that the adhesive roller 31 be arranged outside the housing portion 12, since work in which the adhesiveness of the outer peripheral surface 32 is restored (for example, tasks of peeling off the wound adhesive tape, attaching and detaching the adhesive roller 31 with respect to the shaft portion 34) becomes easy.

In the housing portion 12, the carriage 17 is held in a state able to reciprocate along the scanning direction X that intersects (orthogonal direction in the embodiment) both the vertical direction Z and the movement direction Y. A liquid ejecting portion 18 able to eject a liquid, such as ink, with respect to the printing medium T mounted on the mounting portion 14 in the housing portion 12 is mounted on the carriage 17. The liquid ejecting portion 18 performs printing on the printing medium T by ejecting a liquid with respect to the printing surface Sf of the printing medium T that moves in the movement direction −Y along with the mounting portion 14, and performing textile printing.

Figure 2:
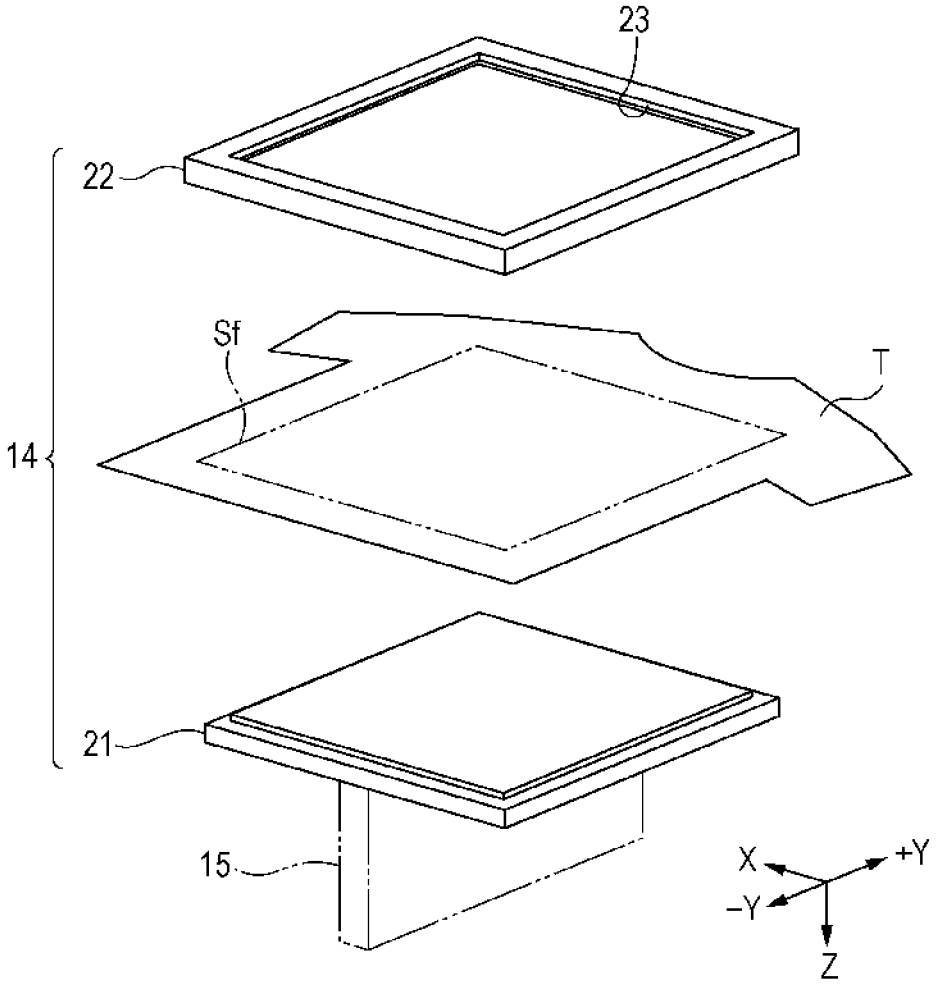
FIG. 2 is a perspective view showing a configuration of a mounting portion on which the printing apparatus of the first embodiment is provided.

As shown in FIG. 2, the mounting portion 14 includes a rectangular plate-like mounting stand 21 attached to the upper portion of the transport portion 15, and a rectangular frame-like frame member 22 that holds the printing surface Sf in a flat state by pinching the printing medium T between the frame member 22 and the mounting stand 21. An opening 23 for exposing the printing surface Sf is formed in the frame member 22. The printing medium T is set on the mounting portion 14 by the frame member 22 being fitted from the printing surface Sf side after the printing medium T is mounted on the mounting stand 21 so as to cover the mounting stand 21.

Figure 3:
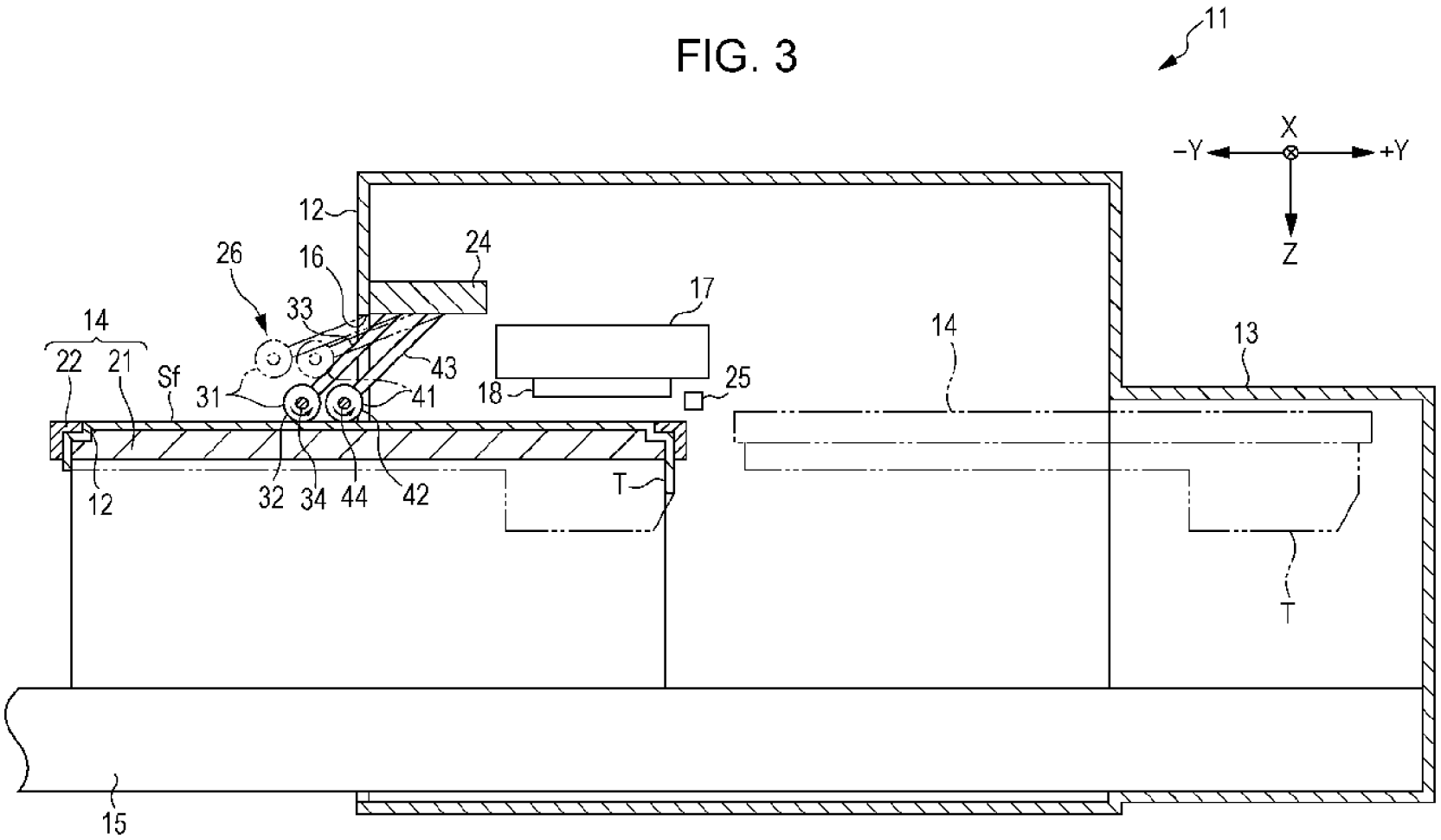
FIG. 3 is a cross-sectional view of a printing apparatus of the first embodiment.

As shown in FIG. 3, the processing mechanism 26 includes a support mechanism 24 that supports the base end side of the rotating support portions 33 and 43 in a rotatable state. When the support mechanism 24 moves the mounting portion 14 forward in the movement direction +Y, the rotating support portions 33 and 43 are rotated, and the pressing roller 41 and the adhesive roller 31 are positioned at the processing position (position shown by the solid line in FIG. 3) able to contact the printing medium T. When the support mechanism 24 moves the mounting portion 14 to return in the movement direction −Y, the rotating support portions 33 and 43 are rotated, and the pressing roller 41 and the adhesive roller 31 are positioned at the retracted position (position shown by the double dotted-dashed line in FIG. 3) not contacting the printing medium T.

Inside the housing portion 12, the detector 25 that detects the presence of an obstruction with respect to liquid ejecting portion 18 on the printing surface Sf pressed by the outer peripheral surface 42 of the pressing roller 41 is arranged further to the downstream side than the liquid ejecting portion 18 in the movement direction +Y. When the mounting portion 14 on which the printing medium T is set moves forward in the movement direction +Y, the detector 25 detects the presence of an obstruction. The detector 25 configures the processing mechanism 26.

The detector 25 is an optical sensor including, for example, a light projecting portion arranged on one end side of the mounting portion 14 in the main scanning direction X, and a light sensing portion arranged at a position able to receive light emitted from the light projecting portion on the other end side in the main scanning direction X of the mounting portion 14. The detector 25, on the one hand, outputs the detection result in which an obstruction is not present in a case in which the light sensing portion senses a fixed amount of light or greater when the light projecting portion emits light, and outputs the detection result in which an obstruction is present in a case in which the amount of light detected by the light sensing portion does not satisfy the fixed amount. The term obstruction refers to, for example, fluff or lint attached to the printing medium T or fibers or wrinkles of the printing medium T that project from the printing surface Sf and have the potential to contact the liquid ejecting portion 18 by being projected toward the liquid ejecting portion 18 side from the mounting portion 14 side.

Since it is better that detector 25 be able to detect the presence of an obstruction prior to printing, the detector may be arranged further downstream than the pressing roller 41 in the movement direction +Y, such as, for example, between the pressing roller 41 and the liquid ejecting portion 18. However, in a case in which the detector 25 is an optical sensor, it is more preferable that the detector 25 be arranged on the interior side separated from the opening portion 16 inside the housing portion 12, since it is possible to suppress mis-detections stemming from the influence of outside light. In the optical sensor, when the light sensing portion senses outside light, there is concern of a mistaken detection result that an obstruction is not present being output, although an obstruction blocks the light emitted by the light projecting portion.

Next, the printing process with respect to a printing medium T subjected to surface processing and surface processing by a processing mechanism 26 will be described.

Setting of the printing medium T with respect to the mounting portion 14 is performed at a set position at which the entire mounting portion 14 is arranged outside the housing portion 12. When setting of the printing medium T with respect to the mounting portion 14 is completed, the transport portion 15 causes the mounting portion 14 to move forward in the movement direction +Y from the set position. Thus, the rotating support portions 33, and 43 rotate, and the pressing roller 41 and the adhesive roller 31 are arranged at a processing position able to contact the printing medium T.

When the mounting portion 14 moves relative to housing portion 12 in a state in which the printing medium T is mounted, the outer peripheral surface 32 of the adhesive roller 31 contacts the printing surface Sf of the printing medium T mounted on the mounting portion 14 according to the relative movement. When the outer peripheral surface 32 of the adhesive roller 31 contacts the printing surface Sf, the adhesive roller 31 is driven and rotates in the counter-clockwise direction (direction indicated by the arrow in FIG. 3) in FIG. 3 in a state in which the outer peripheral surface 32 is in contact with the printing surface Sf. In so doing, according to the rotation of the adhesive roller 31, by adhering fluff, lint or the like attached to the printing medium T to the adhesive outer peripheral surface 32, the attached materials are removed from the printing surface Sf (removal step).

Continuing from the removal step that removes the attached materials with the adhesive roller 31, according to the mounting portion 14 moving relative to the housing portion 12, the outer peripheral surface 42 of the pressing roller 41 presses the printing surface Sf with which the outer peripheral surface 32 of the adhesive roller 31 comes in contact (pressing step). When the outer peripheral surface 42 presses the printing surface Sf, the pressing roller 41 is driven and rotates in the counter-clockwise direction (direction indicated by the arrow in FIG. 3) in FIG. 3 in a state in which the outer peripheral surface 42 is in contact with the printing surface Sf. It is preferable that the adhesive roller 31 rotate in a state in which the outer peripheral surface 32 is in contact with the printing surface Sf, when the outer peripheral surface 42 of the pressing roller 41 that configures the printing portion presses the printing surface Sf.

After the pressing step, according to the mounting portion 14 moving relative to the housing portion 12, the detector 25 detects the presence of an obstruction on the printing surface Sf pressed by the outer peripheral surface 42 of the pressing roller 41 (detection step). In a case in which fraying remains on the printing surface Sf pressed by the pressing roller 41, or a case in which the printing medium T becomes wrinkled, the detector 25 outputs the detection results that an obstruction is present.

When the mounting portion 14 moves to a printing start position (position indicated by the double dotted-dashed line in FIG. 3) that is further to the downstream side than the liquid ejecting portion 18 in the movement direction +Y, the return movement toward the movement direction −Y starts by reversing the movement direction.

In a case in which the detector 25 outputs detection results in which an obstruction is not present during forward movement of the mounting portion 14 in the movement direction +Y, printing (textile printing) is performed by the liquid ejecting portion 18 ejecting liquid with respect to the printing surface Sf of the printing medium T that moves along with the mounting portion 14 during return movement of the mounting portion 14 in the movement direction −Y (liquid ejecting step). That is, the liquid ejecting portion 18 ejects liquid with respect to the printing surface Sf pressed flat by the pressing roller 41 after the adhesive roller 31 removes the attached materials, thereby performing printing.

Since the pressing roller 41 and the adhesive roller 31 are arranged at a retracted position not contacting the printing medium T when the mounting portion 14 moves to return in the movement direction −Y, contact with the printing surface Sf on which printing is performed is avoided. Accordingly, the pressing roller 41 and the adhesive roller 31 come in contact with printing surface Sf while the landed ink on the printing surface Sf is not dried, and lowering of the print quality does not occur.

Meanwhile, in a case in which the detector 25 outputs detection results that an obstruction is present during forward movement in the movement direction +Y of the mounting portion 14, the liquid ejecting portion 18 does not eject liquid during return movement of the mounting portion 14 in the movement direction −Y. That is, when the fluff or an obstruction on the printing medium T, or the like, interferes with the liquid ejecting portion 18 during printing, the print quality is lowered by ejection defect occurring or ink soiling the printing medium T, thus printing is not performed, and the printing medium T returns to the set position.

In a case the detector 25 detecting wrinkles occurring in the printing medium T as an obstruction, after the printing medium T is re-set on the mounting portion 14 that returns to the set position through forward movement, the printing medium T is caused to again move forward in the movement direction +Y along with the mounting portion 14.

Next, the operation of the printing apparatus 11 configured as above will be described.

When attached materials, such as fluff, are attached to the printing medium T, the attached materials may become attached to the liquid ejecting portion 18. When fluff or the like is attached in this was to the liquid ejecting portion 18, mist accompanying the ejection of the liquid condenses on the surface of the fluff or the like and drops onto the printing medium T, thereby causing the print quality to be lowered. On this point, since the printing apparatus 11 includes the adhesive roller 31 that removes the attached materials on the printing surface Sf prior to printing, the attachment of fluff, or the like, with respect to the liquid ejecting portion 18 is suppressed.

However, when separated from the printing surface Sf in contact with the outer peripheral surface 32 having adhesiveness of the adhesive roller 31, the fibers or the like that configure the printing medium T are elongated, and the printing surface Sf becomes fluffed. On this point, since the printing apparatus 11 includes a pressing roller 41 that presses the printing surface Sf, the fraying of the printing surface Sf caused by contact with the adhesive roller 31 is suppressed.

Figure 4:
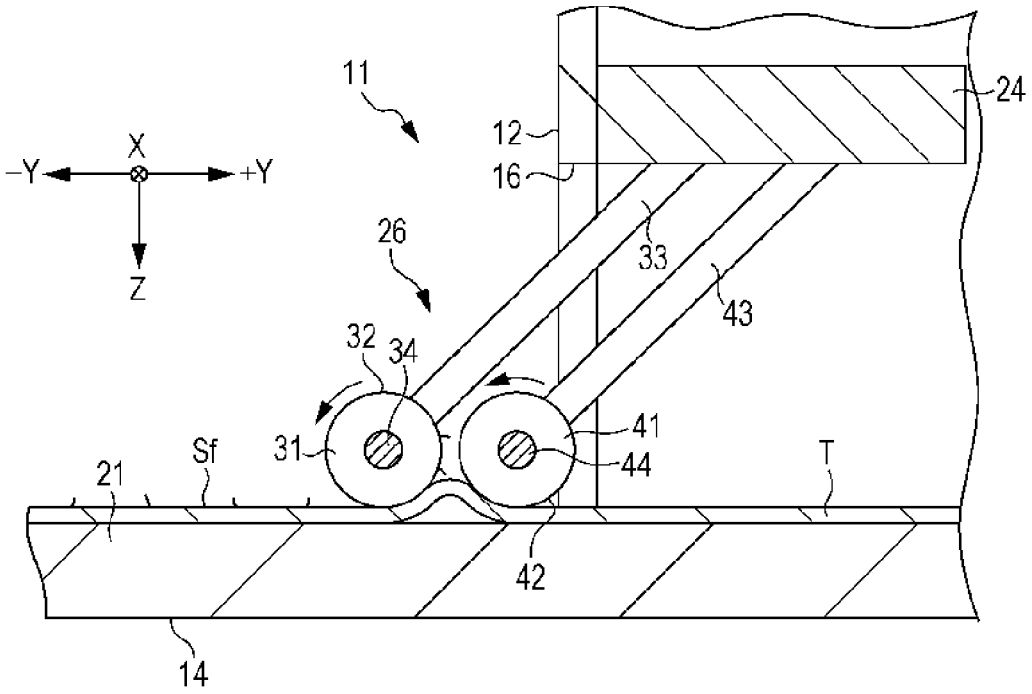
FIG. 4 is a cross-sectional view of a processing mechanism provided in the printing apparatus of the first embodiment.

As shown in FIG. 4, when the adhesive roller 31 rotates in the counter-clockwise direction indicated by the arrow in FIG. 4 in the removal step, the printing medium T applied to the outer peripheral surface 32 further to the downstream side in the movement direction +Y than the adhesive roller 31 may float off the mounting stand 21.

At this time, by the pressing roller 41 pressing the printing surface Sf while rotating in the counter-clockwise direction indicated by the arrow in FIG. 4 on the downstream side in the movement direction +Y of the adhesive roller 31, the printing medium T is pulled away from the adhesive roller 31, and floating away from the mounting stand 21 is suppressed. In order to suppress floating of the printing medium T through the pressing roller 41, it is preferable that the adhesive roller 31 come in contact with the printing medium T in a state in which the pressing roller 41 presses the printing medium T, along with the pressing roller 41 being arranged close to the adhesive roller 31 in the movement direction Y.

In a case in which the printing medium T floats from the mounting stand 21 due to the adhesive force of the adhesive roller 31, thereby generating wrinkles, the wrinkles in the printing medium T are extended by the pressing roller 41 pressing the printing medium T thereafter. In this way, in the pressing step, the printing surface Sf enters a flat state by the pressing roller 41 pressing the pressing surface Sf prior to printing.

The rotation of the adhesive roller 31 in the counter-clockwise direction indicated by the arrow in FIG. 4 in the removal step may attain a state in which rotation in the same direction is slightly regulated by a regulating member coming in contact with the adhesive roller 31. In so doing, it is possible to anticipate an effect in which the wrinkles in the printing medium T are extended, along with being possible to reduce floating away of the printing medium T from the mounting stand 21 due to the adhesive power of the adhesive roller 31 when contacting the printing surface Sf.

In a case in which the attached materials are not removed by the adhesive roller 31, or a case in which the printing surface Sf does not attain a sufficiently flat state due to the pressing roller 41, when the liquid ejecting portion 18 approaches the printing medium T and ejects the liquid, there is concern of fluff or lint attached to the printing medium T coming in contact with the liquid ejecting portion 18, and liquid ejection defects occurring. When printing is performed on such an unflattened printing surface Sf, there is concern of droplets deviating from the landing position in the parts with fraying or wrinkles, thereby lowering the print quality.

On this point, since the printing apparatus 11 includes a detector 25, in a case in which the detector 25 detects a printing medium T in which fraying or wrinkles remain on the printing surface Sf as an obstruction, it is possible for the mounting portion 14 to return to the set position without performing printing. Accordingly, it is possible to avoid a lowering of the print quality caused by ejecting liquid to the printing surface Sf for which the surface state is disturbed by fraying or the like.

In a case in which the detector 25 detects an obstruction, and ejection of ink is not performed when the mounting portion 14 moves to return in the movement direction −Y, the pressing roller 41 and the adhesive roller 31 may come in contact with the printing surface Sf similarly to the forward movement. It is possible to eliminate obstructions by removing fluff on the printing surface Sf through the pressing roller 41 pressing the printing surface Sf, or the adhesive roller 31 removing attached materials on the printing surface Sf.

However, in a case such as the detector 25 detecting wrinkles occurring in the printing medium T as an obstruction, the adhesiveness of the outer peripheral surface 32 is needlessly lost without contributing to the elimination of the obstruction, even if the adhesive roller 31 is in contact with the printing surface Sf. Therefore, when the mounting portion 14 moves to return in the movement direction −Y without performing printing, whereas the pressing roller 41 makes contact with the printing surface Sf, the adhesive roller 31 may not come in contact with the printing surface Sf.

According to first embodiment, the following effects can be obtained.

(1) Since the attached materials attached to the printing surface Sf are removed by the outer peripheral surface 32 of the adhesive roller 31 that contacts the printing surface Sf, it is possible to suppress a lowering of the print quality stemming from attached materials attached to the printing medium T. Although there is concern of the printing surface Sf being fluffed, being wrinkled, or the like, and the condition of the surface thereof being disturbed when the outer peripheral surface 32 of the adhesive roller 31 contacts the printing surface Sf, it is possible to flatten the printing surface Sf by the outer peripheral surface 42 of the pressing roller 41 pressing the printing surface Sf in contact with the outer peripheral surface 32 of the adhesive roller 31. Since the liquid ejecting portion 18 ejects a liquid with respect to a printing surface Sf flattened by the pressing of the outer peripheral surface 42, it is possible to suppress a lowering of the print quality stemming from contact of outer peripheral surface 32.

(2) Since the outer peripheral surface 42 of the pressing roller 41 is harder than the printing medium T, it is possible to flatten the printing surface Sf through the hard outer peripheral surface 42 pressing the printing surface Sf. It is possible to reduce the frictional resistance occurring between the outer peripheral surface 42 of the pressing roller 41 and the printing surface Sf through the pressing roller 41 rotating when the outer peripheral surface 42 of the pressing roller 41 presses the printing surface Sf. Accordingly, it is possible to suppress disturbances in the printing surface Sf that stem from the outer peripheral surface 42 of the pressing roller 41 contacting the printing medium T.

(3) Since the outer peripheral surface 32 of the adhesive roller 31 is adhesive, it is possible to remove the attached materials attached to the printing surface Sf through the adhesive outer peripheral surface 32 contacting the printing surface Sf. It is possible to reduce the frictional resistance occurring between the outer peripheral surface 32 of the adhesive roller 31 and the printing surface Sf by the adhesive roller 31 rotating when the outer peripheral surface 32 of the adhesive roller 31 contacts the printing surface Sf. Accordingly, it is possible to suppress disturbances in the printing surface Sf that stem from the outer peripheral surface 32 of the adhesive roller 31 contacting the printing medium T.

(4) When the adhesive outer peripheral surface 32 separates from the printing surface Sf according to the rotation of the adhesive roller 31, it is possible to peel the printing medium T from the adhesive roller 31 while suppressing floating up of the printing medium T through the outer peripheral surface 42 of the pressing roller 41 pressing the printing surface Sf.

(5) It is possible for the printing medium T mounted on the mounting portion 14, the outer peripheral surface 32 of the adhesive roller 31 held by the housing portion 12, and the outer peripheral surface 42 of the pressing roller 41 to come into contact by the mounting portion 14 moving relative to the housing portion 12 in a state in which the printing medium T is mounted on the mounting portion 14.

(6) It is possible to detect the presence of an obstruction with respect to such a liquid ejecting portion 18 before the obstruction, such as attached materials attached to the printing surface Sf or wrinkles in the printing medium T obstructs the liquid ejecting portion 18 through the detector 25 performing detection on the printing surface Sf pressed by the outer peripheral surface 42 of the pressing roller 41.

Second Embodiment

Next, the second embodiment of the printing apparatus will be described with reference to FIG. 5.

In contrast to the mounting portion 14 moving relative to housing portion 12 in the first embodiment, the printing apparatus 11A of the second embodiment differs in that the housing portion 12A moves relative to the mounting portion 14A. Since members to which the same reference numerals are applied in both embodiments include the same configuration, description thereof will not be made, and description will be provided below focusing on the points of difference from the first embodiment.

Figure 5:
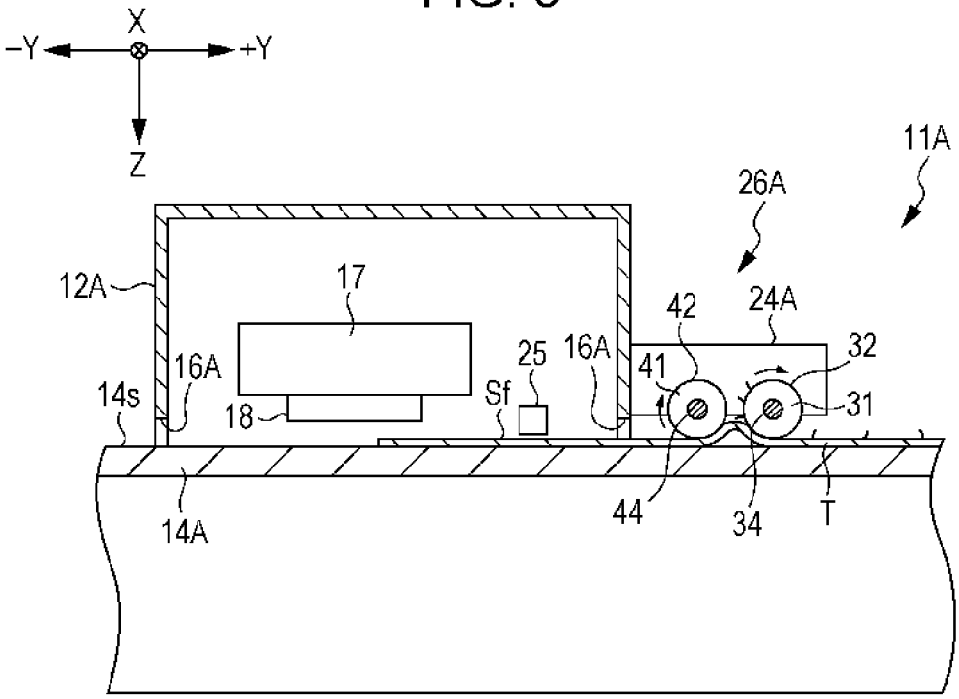
FIG. 5 is a cross-sectional view of a printing apparatus of a second embodiment.

As shown in FIG. 5, the housing portion 12A of the printing apparatus 11A holds the carriage 17 on which the liquid ejecting portion 18 is mounted and the processing mechanism 26A, and reciprocally moves along the movement direction Y (+Y, −Y) with respect to the mounting portion 14A on which the printing medium T is mounted. The movement direction +Y is the right direction in FIG. 5, and the movement direction −Y is the left direction in FIG. 5.

In the housing portion 12A, opening portions 16A are formed in two parallel sidewalls in the movement direction Y and a space is formed that permits relative movement with respect to the mounting portion 14A in the housing portion 12A. The mounting portion 14A is arranged so as to pass through the inside of the housing portion 12A through the opening portion 16A, and has a mounting surface 14*s* on which the printing medium T is mounted. In order to suppress floating of the printing medium T from the mounting surface 14*s*, the mounting portion 14A may include adsorption holes and an adsorption mechanism for the printing medium T to be adsorbed on the mounting surface 14*s*.

The support mechanism 24A that supports the adhesive roller 31 and the pressing roller 41 is held on the outer surface side of the housing portion 12A, and is arranged to the downstream side in the movement direction +Y of the housing portion 12A. The adhesive roller 31 is arranged further to the downstream side in the movement direction +Y than the pressing roller 41.

The detector 25 that configures the processing mechanism 26A is arranged at a position inside the housing portion 12A that is further to the downstream side in the movement direction +Y than the liquid ejecting portion 18. In the second embodiment, since the support mechanism 24A, the adhesive roller 31, and the pressing roller 41 are arranged outside the housing portion 12A, it is possible to make the opening portion 16A smaller than in the first embodiment. Therefore, even if the detector 25 that is an optical sensor is arranged at a position close to the opening portion 16A, it becomes difficult for mis-detections stemming from the influence of outside light to occur.

The support mechanism 24A is movable along the vertical direction Z with respect to the housing portion 12A. The support mechanism 24A supports the adhesive roller 31 via the shaft portion 34 in a freely-rotatable state, and supports the pressing roller 41 via the shaft portion 44 in a freely-rotatable state.

The support mechanism 24A moves downward in the vertical direction when the housing portion 12A moves forward in the movement direction +Y, and is arranged at a processing position at which the pressing roller 41 and the adhesive roller 31 are able to contact the printing medium T. The support mechanism 24A moves upward in the vertical direction when the housing portion 12A moves to return in the movement direction −Y, and is arranged at a retracted position at which the pressing roller 41 and the adhesive roller 31 do not contact the printing medium T.

Next, surface processing by a processing mechanism 26A and the printing process with respect to a printing medium T subjected to surface processing will be described.

In the embodiment, the processing mechanism 26A performs surface processing on the printing medium T when the housing portion 12A moves forward in the movement direction +Y. That is, when the housing portion 12A moves forward in the movement direction +Y, the outer peripheral surface 32 of the adhesive roller 31 contacts the printing surface Sf of the printing medium T mounted on the mounting portion 14A. When the outer peripheral surface 32 of the adhesive roller 31 comes in contact with the printing surface Sf, the adhesive roller 31 is driven and rotates in the clockwise direction (direction indicated by the arrow in FIG. 5) in FIG. 5 in a state in which the outer peripheral surface 32 is in contact with the printing surface Sf. In so doing, according to the rotation of the adhesive roller 31, by adhering fluff, lint or the like attached to the printing medium T to the adhesive outer peripheral surface 32, the attached materials are removed from the printing surface Sf (removal step).

After the adhesive roller 31 removes the attached materials, the outer peripheral surface 42 of the pressing roller 41 presses the printing surface Sf in contact with the outer peripheral surface 32 of the adhesive roller 31 (pressing step). When the outer peripheral surface 42 presses the printing surface Sf, the pressing roller 41 is driven and rotates in the clockwise direction (direction indicated by the arrow in FIG. 5) in FIG. 5 in a state in which the outer peripheral surface 42 is in contact with the printing surface Sf.

After the pressing step, according to the mounting portion 14A moving relative to the housing portion 12A, the detector 25 detects the presence of an obstruction on the printing surface Sf pressed by the outer peripheral surface 42 of the pressing roller 41 (detection step). In a case in which fraying remains on the printing surface Sf pressed by the pressing roller 41, or a case in which the printing medium T becomes wrinkled, the detector 25 outputs the detection results that an obstruction is present.

The removal step, pressing step and detection step are performed according to the forward movement of the housing portion 12A, and when the detector 25 passes through the printing surface Sf, surface processing by the processing mechanism 26A finishes. In a case in which the detector 25 outputs a detection result that an obstruction is not present during the forward movement of the housing portion 12A in the movement direction +Y, the housing portion 12A reverses movement direction and begins return movement toward the movement direction −Y. During return movement of the housing portion 12A in the movement direction −Y, the pressing roller 41 and the adhesive roller 31 retract to a retracted position not contacting the printing medium T by the support mechanism 24A moving upward in the vertical direction.

During return movement of the housing portion 12A in the movement direction −Y, printing (textile printing) is performed by the liquid ejecting portion 18 ejecting liquid with respect to the printing surface Sf of the printing medium T mounted on the mounting portion 14A (liquid ejection step).

During forward movement of the housing portion 12A in the movement direction +Y, in a case in which the detector 25 outputs a detection result that an obstruction is present, the housing portion 12A may not move to return. That is, in the second embodiment, since the printing medium T is exposed on the outside of the housing portion 12A when the forward movement of the housing portion 12A finishes, it is possible to perform elimination of the wrinkles, or the like, detected as an obstruction without performing return movement.

Next, the operation of the printing apparatus 11A configured as above will be described.

Also in the second embodiment, similarly to the first embodiment, along with being able to remove attached materials on the printing medium T through the adhesive roller 31, it is possible to flatten the printing surface Sf prior to printing with the pressing roller 41. It is possible to detect an obstruction with respect to the liquid ejecting portion 18 with the detector 25.

When the adhesive roller 31 rotates in the clockwise direction indicated by the arrow in FIG. 5 in the removal step, on the upstream side in the movement direction +Y of the adhesive roller 31, the printing medium T adhered to the outer peripheral surface 32 may float from the mounting surface 14*s*. At this time, by the pressing roller 41 rotating in the clockwise direction indicated by the arrow in FIG. 5 on the upstream side in the movement direction +Y of the adhesive roller 31, the printing medium T is peeled from the adhesive roller 31 and floating from the mounting surface 14*s* is suppressed.

According to the second embodiment, in addition to the same effects as (1) to (6) above, it is possible to obtain the effects as outlined below.

(7) Since the pressing roller 41 and the adhesive roller 31 are arranged outside the housing portion 12A, for example, it is possible to easily perform tasks such as restoring the adhesiveness of the outer peripheral surface 32 of the adhesive roller 31.

(8) Since the support mechanism 24A, the pressing roller 41 and the adhesive roller 31 are arranged outside the housing portion 12A, it is not necessary to enlarge the configuration inside the housing portion 12A in order to add a function of performing surface processing to the processing mechanism 26A.

Third Embodiment

Next, a third embodiment of the printing apparatus will be described with reference to FIG. 6.

The printing apparatus of the third embodiment differs from the first embodiment in that the liquid ejecting portion performs the printing process and the processing mechanism that is not moving performs surface processing with respect to the printing surface of the printing medium transported in the transport direction. Since members to which the same reference numerals are applied in both embodiments include the same configuration, description thereof will not be made, and description will be provided below focusing on the points of difference from the first embodiment.

Figure 6:
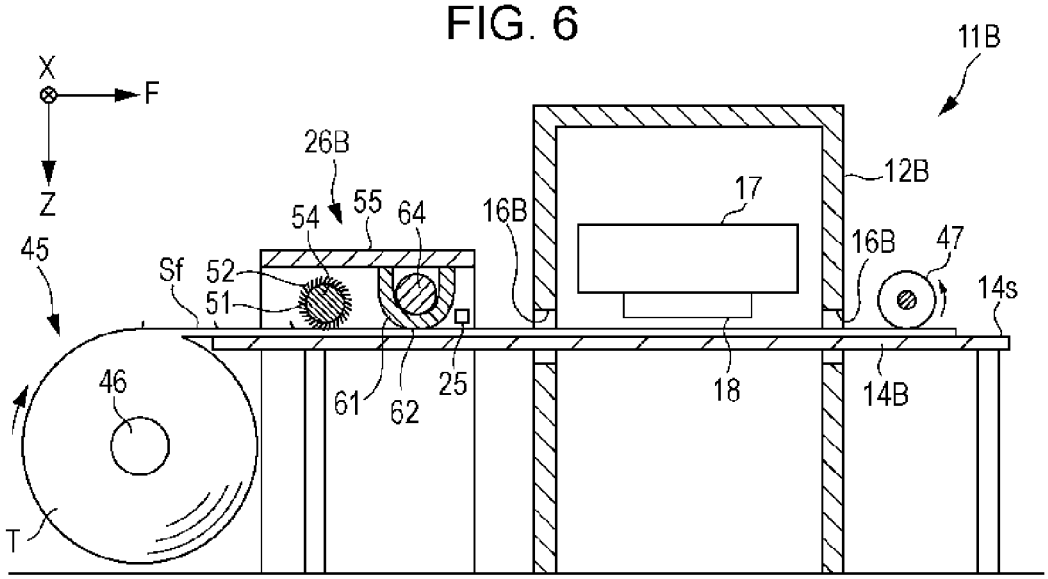
FIG. 6 is a cross-sectional view of a printing apparatus of a third embodiment.

As shown in FIG. 6, the printing apparatus 11B includes a housing portion 12B that holds a carriage 17, a transport mechanism 45 that transports the long printing medium T in the transport direction F, and a processing mechanism 26B arranged further to the upstream side in the transport direction F than the housing portion 12B. The opening portion 16B is formed in two parallel sidewalls in the transport direction F in the housing portion 12B, and a space that permits the printing medium T to pass through is formed in the housing portion 12B.

The transport mechanism 45 includes a support shaft 46, a mounting portion 14B arranged having a mounting surface 14*s* further to the downstream side in the transport direction F than the support shaft 46, and a transport roller 47 for transporting the printing medium T arranged on the mounting surface 14*s*. The mounting portion 14B is arranged so as to pass through the inside of the housing portion 12B through the opening portion 16B.

The printing medium T is formed in a roll shape wrapped around the support shaft 46 and the front end side unwound from the support shaft 46 is mounted on the mounting surface 14*s* of the mounting portion 14B. The transport roller 47, for example, is arranged in a state in which the printing medium T is able to be pinched between the transport roller 47 and the mounting surface 14*s* further to the downstream side than the housing portion 12B in the transport direction F. When the transport roller 47 rotates in the counter-clockwise direction in FIG. 6, the printing medium T mounted on the mounting surface 14*s* is transported in the transport direction F, and the printing medium T is unwound by the support shaft 46 rotating in the clockwise direction in FIG. 6.

In the processing mechanism 26B of the embodiment, the housing portion 12B and the mounting portion 14B are configured as separate bodies. The processing mechanism 26B includes a support member 55, a removal member 51, a pressing member 61 and the detector 25. The removal member 51, pressing member 61 and the detector 25 are supported by the support member 55. The pressing member 61 is arranged further to the downstream side in the transport direction F than the removal member 51, and the detector 25 is arranged further to the downstream side in the transport direction F than the pressing member 61.

The removal member 51 is a rotating brush that includes a base portion 54 that functions as a rotary shaft having a cylindrical outer peripheral surface, and a brush portion 52 having a plurality of brush bristles arranged standing over the entire outer peripheral surface of the base portion 54. In the embodiment, the brush portion 52 configures the removal portion. In a case in which the removal portion is made a brush portion 52, it is possible for the function of removing attached materials from the printing medium T to be restored through recovering the fluff or the like attached to the brush portion 52.

The brush portion 52 may be formed by directly implanting brush bristles in the base portion 54, or may be formed by a pile in which pile yarn is formed incorporated in a foundation cloth being used as the brush bristles, and the foundation cloth in which such a pile is arranged to stand being attached to the base portion 54. In a case of making the pile incorporated in the foundation cloth the brush bristles, pile yarn (loop pile) formed in a loop shape may be used as it is as the brush bristles, or a cut pile in which the loop parts of the pile yarn are cut may be used as the brush bristles.

The pressing member 61 is harder than the printing medium T, has a pressing surface 62 with a smooth surface, and the pressing surface 62 functions as a pressing portion. The pressing member 61 is configured by a material with a high thermal conductivity, such as a metal, and a heat generating element 64 is arranged on the opposite side of the pressing surface 62.

Next, surface processing by a processing mechanism 26B and the printing process with respect to a printing medium T subjected to the surface processing and will be described.

In the embodiment, the processing mechanism 26B performs surface processing with respect to the printing medium T transported in the transport direction F by the transport mechanism 45. That is, when the printing medium T moves relative to the processing mechanism 26B in the transport direction F, the brush portion 52 of the removal member 51 contacts the printing surface Sf of the printing medium T.

At this time, the removal member 51 that is a rotating brush regulates the rotation of the base portion 54 or is rotated in the clockwise direction in FIG. 6. Thus, fluff or lint attached to the printing surface Sf is swept away, and removed from the printing surface Sf by the tips of the brush bristles that configure the brush portion 52 catching on the surface of the printing medium T when the brush portion 52 contacts the printing surface Sf (removal step).

The brush bristles that configure the brush portion 52 are able to effectively remove fluff or link attached to the printing medium T by the tips thereof being inclined toward the upstream side in the transport direction F. When the tips of the brush bristles that configure the brush portion 52 are inclined toward the upstream side in the transport direction F, a force acts on the printing medium T in the reverse direction to the transport direction F. Therefore, it is possible to anticipate an effect of extending the wrinkles in the printing medium T by the brush portion 52 contacting the printing surface Sf.

The pressing surface 62 of the pressing member 61 presses the printing surface Sf in contact with the brush portion 52, after the removal step (pressing step). When the pressing surface 62 presses the printing surface Sf, heat is transferred from the heat generating element 64 to the pressing member 61, and thereby fraying or wrinkles in the printing surface Sf are effectively eliminated by heating.

After the pressing step, the detector 25 detects the presence of an obstruction on the printing surface Sf pressed by the pressing member 61 (detection step). In a case in which fraying remains on the printing surface Sf, or a case in which the printing medium T becomes wrinkled, the detector 25 outputs the detection results that an obstruction is present.

In a case in which the detector 25 outputs detection results in which an obstruction is not present, printing (textile printing) is performed by the liquid ejecting portion 18 ejecting liquid with respect to the printing surface Sf of the printing medium T flattened by the pressing of the pressing surface 62 (liquid ejecting step). Meanwhile, when the detector 25 outputs the detection results in which an obstruction is present, the transport mechanism 45 stops the transport of the printing medium T, and the liquid ejecting portion 18 stops ejection of the liquid.

Next, the operation of the printing apparatus 11B configured as above will be described.

The brush portion 52 that functions as a removal portion in the embodiment does not easily lower in ability to remove attached materials compared to a removal portion that removed attached materials through adhesion. Since a force acts on the printing medium T in the reverse direction to transport direction F through the brush portion 52 contacting the printing surface Sf, it is possible to perform the pressing step in a state in which the wrinkles in the printing medium T are straightened.

When the wrinkles are straightened in the reverse direction to the transport direction F by such a brush portion 52, there is concern of the printing medium T becoming slack on the upstream side in the transport direction F due to the brush portion 52 if the support shaft 46 is rotated in order to transport the printing medium T. Therefore, in a case in which the transport force due to the transport roller 47 is made stronger than the transport force due to the support shaft 46 or surface processing or printing process is performed, it is preferable that the support shaft 46 be driven and rotate without being driven to rotate.

In the pressing step, although there is concern of the printing medium T being creased when the wrinkles or warped printing medium T is pressed, it is possible to reduce the concern thereof by performing the pressing after the wrinkles in the printing medium T are straightened by the brush portion 52.

The printing apparatus 11B, the wrinkles in the printing medium T are straightened between the pressing surface 62 and the transport roller 47 by the transport roller 47 rotating and driving further to the downstream side in the transport direction F than the pressing surface 62 in a state in which the pressing surface 62 presses the printing medium T. Since the liquid ejecting portion 18 is between the pressing surface 62 and the transport roller 47 in the transport direction F, it is possible to perform printing on the printing medium T in which the wrinkles are straightened in this way.

In a case in which a gap is provided between the processing mechanism 26B and the housing portion 12B in the transport direction F and the detector 25 detects an obstruction, it may be possible for the work of eliminating the wrinkles in the printing medium T to be performed with a gap between the processing mechanism 26B and the housing portion 12B.

Alternatively, in a case in which the detector 25 detects an obstruction, the surface processing may be performed again by transporting the printing medium T in the transport direction F after the recording medium T is rewound by the support shaft 46 being rotated in the counter-clockwise direction in FIG. 6. In a case in which the printing medium T is transported in the reverse direction to the transport direction F, or a case in which the printing medium T is fed in the transport direction F without performing surface processing, the transport of the printing medium T is not obstructed if the removal member 51 that is a rotating brush is driven and rotates.

According to the third embodiment, in addition to the same effects as (1) and (6) above, it is possible to obtain the effects as outlined below.

(9) Since the processing mechanism 26B is provided as a separate body to the housing portion 12B and the transport mechanism 45, it is possible to perform surface processing on the printing medium T without modifying the configuration of the printing apparatus 11B.

Fourth Embodiment

Figure 7:
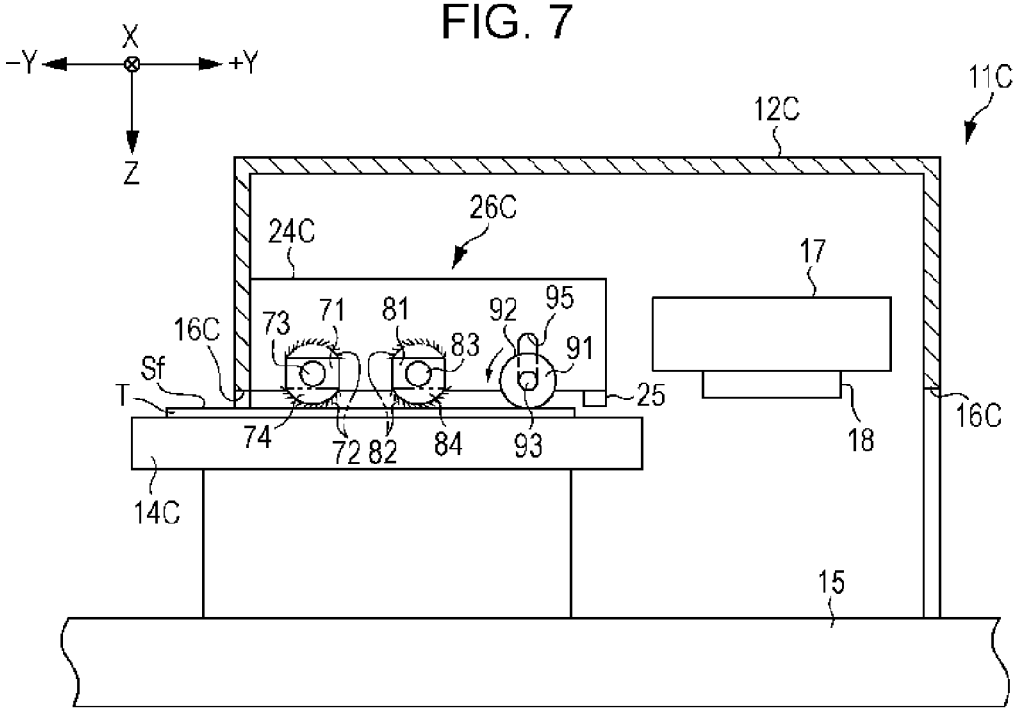
FIG. 7 is a cross-sectional view of a printing apparatus of a fourth embodiment.

Next, a fourth embodiment of the printing apparatus will be described with reference to FIG. 7.

In the first embodiment, with respect to the removal portion and the pressing portion being the outer peripheral surface of the roller that is a rotating body, the printing apparatus of the fourth embodiment differs from the first embodiment in that the removal portion and the pressing portion are a brush portion having brush bristles. Since members to which the same reference numerals are applied in both embodiments include the same configuration, description thereof will not be made, and description will be provided below focusing on the points of difference from the first embodiment.

The printing apparatus 11C of the present embodiment includes a substantially rectangular box-like housing portion 12C, a mounting portion 14C able to reciprocate in a state in which the printing medium T is mounted, and a transport portion 15 for the mounting portion 14C to be reciprocated. The carriage 17 on which the liquid ejecting portion 18 is mounted and the processing mechanism 26C are accommodated in the housing portion 12.

The transport portion 15 moves the mounting portion 14C forward in the movement direction +Y, when the processing mechanism 26C performed surface processing on the printing medium T. The transport portion 15 moves the mounting portion 14C to return in the movement direction −Y, when the liquid ejecting portion 18 ejects liquid with respect to the printing medium T to perform printing. An opening portion 16C that permits the mounting portion 14C to enter and exit the housing portion 12C when the mounting portion 14C moves along the movement direction Y (+Y, −Y) is formed in the housing portion 12C.

The processing mechanism 26C includes a support mechanism 24C, removal member 71, a pressing member 81 arranged further to the downstream side in the movement direction +Y than the removal member 71, a pressing roller 91 arranged further to the downstream side in the movement direction +Y than the pressing member 81, and a detector 25 arranged further to the downstream side in the movement direction +Y than the pressing roller 91. The support mechanism 24C holds the removal member 71, the pressing member 81, the pressing roller 91 and the detector 25.

The removal member 71 includes a rotating shaft 73 supported on the support mechanism 24C to be able to rotate, a plate-like base portion 74 supported on the rotating shaft 73, and a brush portion 72 having a plurality of brush bristles arranged standing on one surface side of the base portion 74. In the present embodiment, the brush portion 72 configures the removal portion.

The pressing member 81 includes a rotating shaft 83 supported on the support mechanism 24C to be able to rotate, a plate-like base portion 84 supported on the rotating shaft 83, and a brush portion 82 having a plurality of brush bristles arranged standing on one surface side of the base portion 84. In the present embodiment, the brush portion 82 configures the first pressing portion. It is preferable that the brush portion 82 that is a pressing portion have a higher contact pressure with respect to the printing medium T than the brush portion 72 that is a removal portion.

The pressing roller 91 includes a harder outer peripheral surface 92 than the printing medium T, and a rotating shaft 93. Both ends of the rotating shaft 93 are accommodated in long holes 95 extending in the vertical direction Z formed in the support mechanism 24C. The outer peripheral surface 92 of the pressing roller 91 configures the second pressing portion. The pressing roller 91 is supported by the support mechanism 24C in a state of being rotatable via the rotating shaft 93.

When the support mechanism 24C moves the mounting portion 14C forward in the movement direction +Y, the rotating shafts 73 and 83 are rotated, and when the brush portions 72 and 82 are positioned at the processing position (position indicated by the solid line in FIG. 7) able to contact the printing medium T, the rotating shaft 93 is moved downward along the long hole 95, and the pressing roller 91 is arranged at the processing position (position indicated by the solid line in FIG. 7) able to contact the printing medium T. When the brush portion 72 is arranged at the processing position, the brush bristles that configure the brush portion 72 enter a state in which the tips thereof are inclined toward the upstream side in the movement direction +Y. When the brush portion 82 is arranged at the processing position, the brush bristles that configure the brush portion 82 enter a state in which the tips thereof are inclined toward the downstream side in the movement direction +Y.

When the support mechanism 24C moves the mounting portion 14C to return in the movement direction −Y, the rotating shafts 73 and 83 are rotated, and when the brush portions 72 and 82 are positioned at the retracted position (position indicated by the double dotted-dashed line in FIG. 7) not contacting the printing medium T, the rotating shaft 93 is moved upward along the long hole 95, and the pressing roller 91 is arranged at the retracted position not contacting the printing medium T. When the brush portions 72 and 82 are arranged at a retracted position, the task of recovering the fluff or the like attached to the brush portions 72 and 82 may be performed.

Next, surface processing by a processing mechanism 26C and the printing process with respect to a printing medium T subjected to the surface processing and will be described.

When the mounting portion 14C moves relative to housing portion 12C in a state in which the printing medium T is mounted, the brush portion 72 of the removal member 71 contacts the printing surface Sf of the printing medium T mounted on the mounting portion 14 according to the relative movement. By the brush bristles inclined toward the upstream side in the transport direction F sweeping away fluff or lint attached to the printing surface Sf when the brush portion 72 contacts the printing surface Sf, the attached materials are removed from the printing surface Sf (removal step).

Continuing from the removal step, according to the mounting portion 14C moving relative to the housing portion 12C, the brush portion 82 of the pressing member 81 presses the printing surface Sf with which the brush portion 72 is in contact (first pressing step). According to the mounting portion 14C moving relative to the housing portion 12C, the pressing roller 91 is driven and rotates in the counter-clockwise direction indicated by the arrow in FIG. 7 in a state in which the outer peripheral surface 92 is in contact with the printing surface Sf (second pressing step).

After the second pressing step, similarly to the first embodiment, the detector 25 detects the presence of an obstruction on the printing surface Sf pressed by the brush portion 82 and the pressing roller 91 (detection step). In a case in which the detector 25 outputs detection results in which an obstruction is not present, printing (textile printing) is performed by the liquid ejecting portion 18 ejecting liquid with respect to the printing surface Sf of the printing medium T that moves along with the mounting portion 14C during return movement of the mounting portion 14C in the movement direction −Y (liquid ejecting step).

In a case in which the detector 25 outputs detection results in which an obstruction is not present, the mounting portion 14C stops further to the downstream side in the movement direction +Y than the housing portion 12C. That is, in a case in which an obstruction is detected, printing on the printing medium T is not performed. The work of re-setting the printing medium T on the mounting portion 14C that is stopped further to the downstream side in the movement direction +Y than the housing portion 12 is performed.

Next, the operation of the printing apparatus 11C configured as above will be described.

The brush portion 72 that functions as a removal portion in the embodiment does not easily lower in ability to remove attached materials compared to a removal portion that removes attached materials through adhesion. Since a force acts on the printing medium T in the reverse direction to the movement direction +Y through the brush portion 72 contacting the printing surface Sf, it is possible to perform the pressing step in a state in which the wrinkles in the printing medium T are straightened.

In the removal step, since the brush portion 72 in which the brush bristles are inclined toward the upstream side in the transport direction F has a form so as to rub the printing surface Sf against the grain, the fibers or the like that configure the printing medium T stand up, and the printing surface Sf is fluffed up. The printing apparatus 11C prepares the direction of the fluff or fibers of the printing medium T through the brush portion 82 in which the brush bristles are inclined toward the downstream side in the transport direction F which is the reverse direction to the brush portion 72 in the first pressing step being in sliding contact with the printing surface Sf, thereby suppressing fraying on the printing surface Sf. In the second pressing step, by the outer peripheral surface 92 of the pressing roller 91 pressing the printing surface Sf in which the orientation of the fibers is prepared, the printing surface Sf enters a flatter state.

In the first pressing step, since a force acts on the printing medium T in the movement direction +Y through the brush portion 82 contacting the printing surface Sf, there is concern of the printing medium T sagging and wrinkles occurring on the downstream side in the movement direction +Y of the brush portion 82. In the embodiment, sagging of the printing medium T is suppressed by the pressing roller 91 rotating in the counter-clockwise direction indicated by the arrow in FIG. 7 while pressing the printing medium T on the downstream side in the movement direction +Y of the brush portion 82. Accordingly, it is possible to suppress disturbances in the printing surface Sf stemming from contact with the brush portion 82.

According to the fourth embodiment, in addition to the same effects as (1), (2), (5), and (6) above, it is possible to obtain the effects as outlined below.

(10) It is possible to arrange the orientation of the fluff or fibers of the printing medium T by performing the first pressing step with the brush portion 82.

Each embodiment may be modified as outlined below.

The mounting portion may be configured to be movable in the vertical direction Z. According to the configuration, if the mounting portion 14 may be moved downward in the vertical direction, it is possible for the removal portion and the pressing portion to not contact the printing medium T. Therefore, in a case of adopting the configuration, movement of the removal portion and the pressing portion may be not performed by the support mechanism.

The detector 25 may be not provided in the processing mechanism.

The removal portion may perform surface processing after a separate pressing portion presses the printing surface Sf. According to the configuration, it is possible to reduce the amount of attached materials left behind by the removal portion coming in contact the flattened printing surface Sf through pressing of the pressing portion.

The removal portion may be a planar adhesive surface. Even in this case, it is possible to remove the attached materials attached to the printing surface Sf by the removal portion moving in a direction approaching and a direction separating with respect to the printing surface Sf. In a case adopting such a configuration, when a pressing portion is arranged on both sides of the removal portion in a processing direction that performed surface processing (for example, direction along the movement direction Y or the transport direction F) and the adhesive surface separates from the printing surface Sf, it is preferable to suppress floating of the printing medium. However, it is more preferable to make the removal portion the outer peripheral surface of the roller or a brush portion and make a configuration able to continuously contact the printing surface Sf, since it is possible to continuously perform surface processing.

The configuration may be changed to a so-called full line-type liquid ejecting apparatus in which a fixed liquid ejecting portion with a long form corresponding to the overall width of the printing medium T is provided without providing carriage 17 that moves with the liquid ejecting portion mounted. The liquid ejecting portion in this case has a printing range spanning the entire width of the printing medium T by arranging a plurality of unit head portions in which nozzles that eject a liquid are formed in parallel, or may have a printing range spanning the entire width of the printing medium T by arranging numerous nozzles in a single long head so as to span the entire width of the printing medium T.

The printing medium T is not limited to a fabric, and may be a plastic film, a plate material, or the like. That is, according to the processing mechanism of the embodiment, it is possible to also remove, for example, dust attached to a plastic film, or sawdust attached to a plate material or the like, through contact of the removal portion (for example, sliding contact or adhesion). If using a configuration in which the mounting portion 14 and the liquid ejecting portion move relative to one another, it is possible to perform printing with respect to an inflexible printing medium, and thus the printing medium may be a thick panel or board without being limited to a sheet-like medium. The liquid used in printing may be a fluid other than ink (including a liquid, or a fluid body such as a liquid-like body or gel in functional particles are dispersed or mixed in a liquid).

The entire disclosure of Japanese Patent Application No. 2013-230033, filed Nov. 6, 2013 is expressly incorporated by reference herein.

What is claimed is:

1. A printing apparatus comprising:

a removal portion that removes foreign materials that are not part of a printing surface of a printing medium and that are attached to the printing surface, the removal portion removing the foreign materials by contacting the printing surface;

a movable, planar mounting portion that supports the printing medium as the removal portion contacts the printing surface of the printing medium;

a pressing portion that presses the printing surface against the movable, planar mounting portion after the removal portion is in contact with the printing surface, the pressing portion including a pressing surface having a length corresponding to a width of the printing surface that intersects a positive transport direction of the printing medium; and a liquid ejecting portion that performs printing by ejecting a liquid on the printing surface pressed by the pressing portion, wherein, during at least a portion of the movement of the movable, planar mounting portion in the positive transport direction towards the liquid ejecting portion, which is downstream the removal portion and the pressing portion, the movable, planar mounting portion simultaneously supports a portion of the printing surface at the liquid ejecting portion, the removal portion and the pressing portion.

2. The printing apparatus according to claim 1, further comprising:

a pressing roller that includes a harder outer peripheral surface than the printing medium as the pressing surface, and is able to rotate in a state in which the hard outer peripheral surface is in contact with the printing surface, wherein the pressing portion is formed from the outer peripheral surface of the pressing roller.

3. The printing apparatus according to claim 1, wherein the removal portion is an adhesive portion including an adhesive surface with adhesiveness provided to be able to contact the printing surface.

4. The printing apparatus according to claim 3, wherein the adhesive surface is an outer peripheral surface of an adhesive tape wound into a roll, the adhesive tape being possible to be peeled off.

5. The printing apparatus according to claim 1, wherein the removal portion is a brush portion that includes a plurality of brush bristles provided to be able to contact the printing surface.

6. The printing apparatus according to claim 5, wherein tips of the plurality of brush bristles are inclined toward upstream side in the positive transport direction in the contact state.

7. The printing apparatus according to claim 1, wherein the removal portion is provided on the outer peripheral surface of the removal roller that is able to rotate in a state in which the outer peripheral surface is in contact with the printing surface.

8. The printing apparatus according to claim 7, wherein the removal roller rotates in a state in which the outer peripheral surface is in contact with the printing surface, when the pressing portion presses the printing surface.

9. The printing apparatus according to claim 7, wherein the rotation of the removal roller driven by the printing medium transported in the positive transport direction in the contact state is regulated.

10. The printing apparatus according to claim 1, further comprising:

a housing portion that holds the removal portion, the pressing portion, and the liquid ejecting portion; and the mounting portion that moves relative to the housing portion in a state in which the printing medium is mounted on the mounting portion;

wherein the removal portion and the pressing portion contact the printing surface of the printing medium mounted on the mounting portion according to the relative movement of the mounting portion.

11. The printing apparatus according to claim 1, further comprising:

a detector that detects the presence of an obstruction with the potential to interfere with respect to the liquid ejecting portion by projecting from the printing surface, on the printing surface pressed by the pressing portion.

12. The printing apparatus according to claim 1, wherein the removal portion makes a force that acts on the printing surface in a reverse direction to the positive transport direction in the contact state, when the pressing portion presses the printing surface of the printing medium transported in the positive transport direction.

13. The printing apparatus according to claim 1, wherein the pressing portion is grounded.

14. The printing apparatus according to claim 1, wherein the pressing portion heats the printing medium in the contact state.

15. The printing apparatus according to claim 1, wherein the removal portion and the pressing portion are disposed next to each other in the positive transport direction upstream of the liquid ejecting portion and press the printing medium against the mounting portion extending from the removal portion and the pressing portion to the liquid ejecting portion.

16. A printing method comprising:

removing foreign materials that are not part of a printing surface of a printing medium and that are attached to a the printing surface by a removal portion coming in contact with a printing surface of the printing medium;

pressing the printing surface of the printing medium by a pressing portion at a pressing region after the removal, the pressing portion pressing against a movable, planar mounting portion which is movable from the removal portion and the pressing portion to a liquid ejection portion;

transporting the printing medium toward the liquid ejecting region where the liquid ejecting portion is located after the pressing, during transporting the printing medium, at least a portion of the movable, planar mounting portion simultaneously supports a portion of the printing surface at the liquid ejecting portion, the removal portion and the pressing portion;

ejecting a liquid on the printing surface of the printing medium by the liquid ejecting portion at the liquid ejecting region after the transporting toward the liquid ejecting region; and transporting the printing medium from the liquid ejecting region toward the pressing region in a state where the pressing portion is moved to a position not in contact with the printing surface of the printing medium.

17. The printing method according to claim 16, further comprising:

detecting presence of an obstruction with potential to interfere with respect to the liquid ejecting portion after the pressing, wherein the printing medium is transported toward the pressing region without ejecting in a case presence of the obstruction is detected.

* * * * *